United States Patent [19]

Lenhart

[11] Patent Number: 4,581,538

[45] Date of Patent: Apr. 8, 1986

[54] RADIATION SHIELD

[75] Inventor: Mark J. Lenhart, Manchester, Mass.

[73] Assignee: Colonial X-Ray Corporation, Woburn, Mass.

[21] Appl. No.: 537,986

[22] Filed: Sep. 30, 1983

[51] Int. Cl.[4] ..... G21F 3/02

[52] U.S. Cl. ..... 250/519.1; 250/515.1

[58] Field of Search ..... 250/515.1, 519.1

[56] References Cited

U.S. PATENT DOCUMENTS

| | | | |
|---|---|---|---|
| 1,607,140 | 11/1926 | Wappler . | |
| 1,907,523 | 5/1933 | Egressi et al. | 250/519.1 |
| 3,488,495 | 1/1970 | Schneeman | 250/492.1 |
| 3,967,129 | 6/1976 | Winkler | 250/510 |
| 3,980,889 | 9/1976 | Haas et al. | 250/492.1 |
| 3,984,695 | 10/1976 | Collica et al. | 250/ |
| 4,062,518 | 12/1977 | Stivender et al. | 250/519.1 |
| 4,156,146 | 5/1979 | Imai et al. | 250/506 |
| 4,254,341 | 3/1981 | Herr | 250/519 |

FOREIGN PATENT DOCUMENTS

| | | | |
|---|---|---|---|
| 2313201 | 9/1974 | Fed. Rep. of Germany . | |
| 1164093 | 10/1958 | France | 250/519.1 |

*Primary Examiner*—Bruce C. Anderson

[57] ABSTRACT

A shield for protecting a person from radiation being used to irradiate a work area, while permitting the person to observe and to have access to the work area, including a radiation-shielding observation window, and a flexible, mechanically penetrable radiation-shielding curtain adjacent the window.

10 Claims, 4 Drawing Figures

FIG. 1
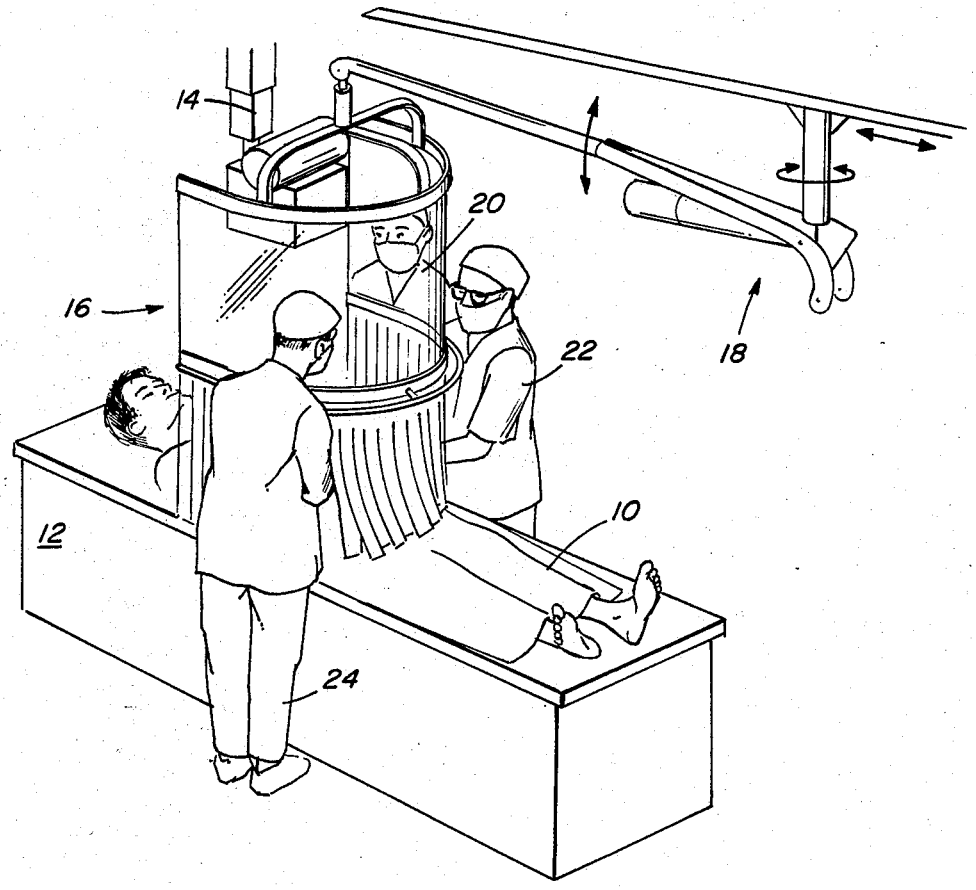
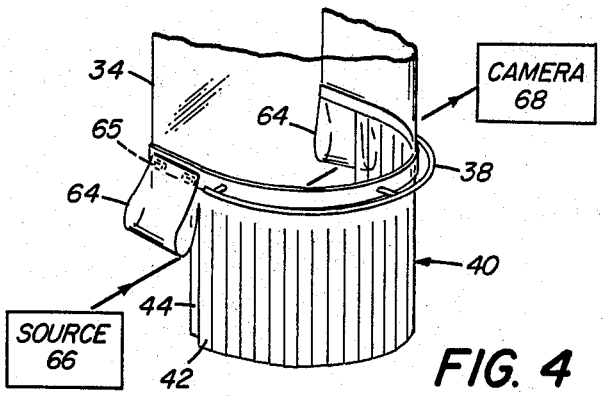
FIG. 4

RADIATION SHIELD

BACKGROUND OF THE INVENTION

This invention relates to radiation shielding, for example for protecting medical personnel from X-rays used in diagnosis or treatment.

Because of the hazards of exposure to radiation, such personnel must be shielded against X-rays which may leak from the X-ray source, or are scattered from the air, from the patient, and from reflective surfaces in the vicinity of the patient.

In performing procedures such as angiographic examinations or embolizations, several people may need to be near the source of radiation for relatively long periods (e.g., several hours) and must be able to observe and have access to the patient. Some procedures use two sources of X-rays located at different positions.

Herr et al. (U.S. Pat. No. 4,254,341) disclose shielding one person's torso by suspending a conventional lead apron on a track suspension system. In Mansker (U.S. Pat. No. 3,308,297), a shielding screen includes a flat observation window of leaded glass and a rigid working hood with a port through which instruments can be manipulated. German OGS No. 2313201 shows a shield which protects against patient scattered X-rays using two screens at right angles to one another, each screen having a series of overlapping flaps.

SUMMARY OF THE INVENTION

In general, the invention features a shield for protecting a person from radiation being used to irradiate a work area, while permitting the person to observe and to have access to the work area, the shield including a radiation-shielding observation window, and a flexible, mechanically penetrable radiation-shielding curtain adjacent the window.

In preferred embodiments, the shield is U-shaped and sized to enclose the space between the source (e.g. of X-rays) and the work area (e.g., a portion of a patient's body) on at least three sides, to permit at least two people simultaneously to observe and have access to the work area; the window is shaped and positioned to shield the eyes both from radiation coming directly from the source and from radiation scattered from the vicinity of the work area; the window and curtain are shaped and positioned to shield the entire head and torso; the curtain includes a supporting frame and a series of flexible radiation-shielding flaps each suspended at one end from the frame, each flap being at least partially overlapped by another flap, whereby the curtain can be mechanically penetrated at each place where adjacent flaps overlap, and the flaps can conform to the contour of the work area; there is a handle for controlling the position of the shield, the handle being accessible from any location about the shield; there is a connector for connecting the window and curtain to a means for supporting the shield above the work area, and for enabling the shield to have any selected orientation with respect to the work area; and the window is a lead-impregnated, transparent acrylic copolymer resin sheet comprising a double layer of lead vinyl sheeting, each layer having a lead equivalency of 0.50 millimeters.

The shield protects the entire heads and torsos of several people from radiation either emanating directly from the source or scattered by the air and reflective surfaces in the vicinity of the work area. All of the shielded people can both observe the work area and have access to the work area from any position around at least three sides of the work area. The shield can be easily moved to any desired location or orientation.

Other advantages and features will become apparent from the following description of the preferred embodiment, and from the claims.

DESCRIPTION OF THE PREFERRED EMBODIMENT

We first briefly describe the drawings.

Drawings

FIG. 1 is a perspective view of a shield in use according to the preferred embodiment.

FIG. 4 is an isometric view of an alternative shield curtain.

Structure

Figures 2, 3:
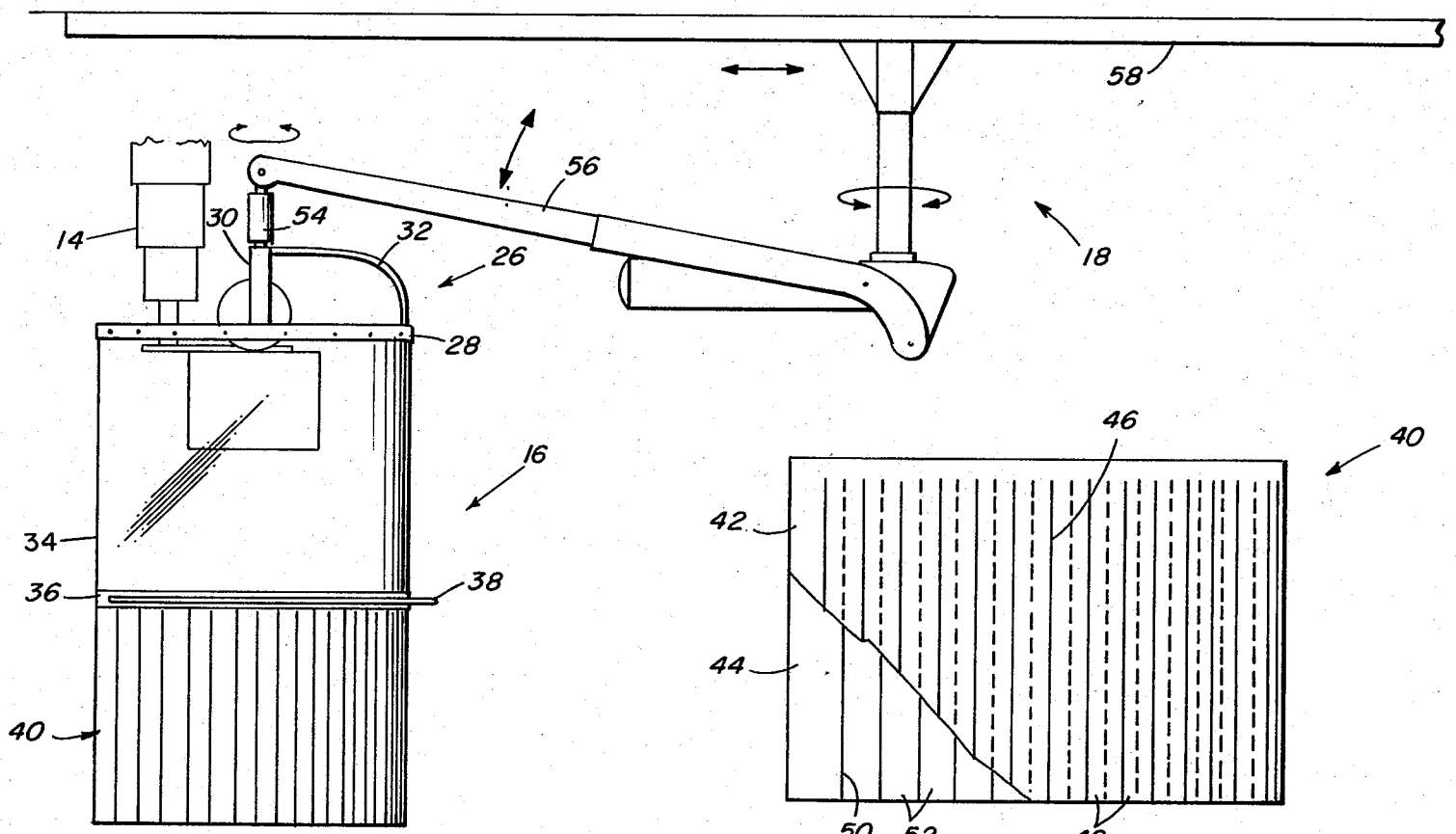
FIG. 2 is a side view of the shield together with a suspension system.
FIG. 3 is an enlarged side view of the shield curtain with one layer partially cut away.

Referring to FIG. 1, in a special procedure room for angiographic examinations, patient 10 lying on table 12 is positioned with his torso (i.e., the work area, hidden in FIG. 1) in the line of X-rays delivered from conventional source 14. Shield 16, suspended from suspension system 18 (attached to the ceiling and shown out of scale in FIG. 1) is positioned to shield medical personnel 20, 22, 24 from X-rays traveling directly from source 14 or scattered from the air, from the patient, or from reflective surfaces in the vicinity of the work area.

Referring to FIG. 2, shield 16 includes a supporting frame 26 having stainless steel angle 28 formed as a u-shape (having dimensions corresponding to the width of table 12, e.g. a U-shape approximately 26 inches long and 29 inches across) to which are welded two curved pieces 30, 32 of stainless steel channel as shown. The shape and size of frame 26 is appropriate to permit it to clear source 14 with angle 28 at or above the point at which the X-rays exit source 14. A thermo-formed u-shaped 12 mm thick lead-impregnated, transparent acrylic copolymer resin observation window 34, about 23 inches high (available as Clear-Pb ™ from Nuclear Associates, 100 Voice Rd., Carle Place, NY) is suspended by its upper edge from angle 28 using screws mounted in drilled and tapped holes. Window 34 has a shielding ability equivalent to 0.50 millimeters of lead. The bottom edge of window 34 is screwed into a u-shaped stainless steel base bracket 36 having a t-shaped cross section. A wrap-around handle 38 of ¾" diameter stainless steel tubing is welded via tubular stainless steel supports to the outer surface of bracket 36. An 18" high u-shaped flexible, penetrable radiation-shielding curtain 40 of lead-vinyl sheeting is hung by its upper edge from bracket 36 by screws which pass through a stainless steel supporting band, then through curtain 40 and into drilled and tapped holes in bracket 36.

Referring to FIG. 3, curtain 40 has two overlapping layers 42, 44 of 1/16" thick lead-vinyl sheeting (available as Leadx ® from Bar-Ray, Inc., Brooklyn, NY), each layer having a shielding ability equivalent to 0.50 millimeters of lead. Layer 42 has a series of equally spaced vertical cuts 46 each extending from the bottom edge of layer 42 to a point near its top edge, thus defining a series of 2" wide flaps 48. Layer 44 has similar cuts 50 defining similar flaps 52 except that flaps 52 are staggered with respect to flaps 48 as shown.

Referring again to FIG. 2, shield 16 is hung on hanger 54 of conventional suspension system 18 (available from Varimex, Warsaw, Poland). System 18 also includes arm mechanism 56 and track 58 permitting complete freedom in adjusting the position of shield 16 in all dimensions. Hanger 54 permits shield 16 to be rotated 360° so that its open end can be aimed in any direction.

Operation

In use, shield 16 is positioned, using handle 38, so that the open end faces a direction in which medical personnel 20, 22, 24 will not be located, and so that the shield spans the entire vertical distance from X-ray source 14 to patient 10 and table 12. The flexibility of flaps 48 and 52 permits them to be draped over patient 10 and table 12 to form a continuous barrier to the penetration of X-rays beyond the work area thus shielding medical personnel 20, 22, 24. The configuration of supporting frame pieces 30, 32 permits frame 26 to clear the housing of X-ray source 14, with the top edge of window 34 positioned as high as source 14. Stray X-rays which may leak from source 14 in a direction other than the work area are thus blocked by shield 16 as are X-rays scattered from patient 10, table 12, and the air. Several medical personnel at one time, can observe the patient, participate in a procedure, and move freely about the patient, with their entire bodies, including eyes, head and torso shielded from the X-rays. If it becomes necessary to touch the patient, a hand can easily be reached in between flaps 48, 52 without moving shield 16, and with minimum exposure to radiation.

Other embodiments are within the following claims.

For example, referring to FIG. 4, for biplane angiography the first three cuts 46 in layer 42 beginning on each side of curtain 40 at the open end of shield 16 are omitted, thus forming a continous eight-inch wide flap 64. The first six inches of layer 44 beginning on each side of curtain 40 at the open end of shield 16 is eliminated. Hoop and loop fastening strips 65 are attached to the outer bottom edge of each flap 64 and to the bracket 36 so that flaps 64 can be peeled up and attached by their bottom edges to bracket 36, thus permitting a second x-ray source 66 and corresponding camera 68 to be used as shown. Flaps 64 continue to provide shielding over about half the height of curtain 40.

I claim:

1. A shield for protecting personnel from radiation being used to irradiate a work area while permitting observation and access to the work area, said shield comprising:

a supporting frame;

a connector for connecting said frame to an overhead suspension system for supporting said shield above said work area;

a radiation-shielding observation window connected to and extending below said frame said window sized and shaped to enclose the space between the source of said radiation and said work area on least three sides;

a radiation-shielding curtain suspended at one end adjacent and below said window about at least said three sides, said curtain comprising a plurality of overlapping flexible radiation shielding flaps adapted for mechanical penetration and adapted to conform to the contour of the work area; and said shield having height above at least said three sides such that with said curtain at the surface of said work area, said window extends at least as high as the point at which radiation emanates from said source and above the height of personnel outside said enclosed space.

2. The shield of claim 1 sized and shaped to permit at least two people simultaneously to observe and have access to the work area.

3. The shield of claim 2 wherein said window and curtain are U-shaped.

4. The shield of claim 3 wherein said window comprises a lead-impregnated, transparent acrylic copolymer resin sheet.

5. The shield of claim 4 wherein said sheet has a lead equivalency of 0.50 millimeters.

6. The shield of claim 1 wherein said supporting frame further comprises a handle for controlling the position of said shield, said handle being accessible from any location about said shield.

7. The shield of claim 1 wherein said connector comprises means for enabling said shield to have any selected orientation with respect to said work area.

8. The shield of claim 1 wherein said window comprises a lead-impregnated, transparent acrylic copolymer resin sheet.

9. The shield of claim 1 wherein said sheet has a lead equivalency of 0.50 millimeters.

10. The shield of claim 1 wherein said curtain comprises a double layer of lead-vinyl sheeting, each layer having a lead equivalency of 0.50 millimeters.

* * * * *